US011537073B2

(12) United States Patent
Yoshikawa et al.

(10) Patent No.: US 11,537,073 B2
(45) Date of Patent: Dec. 27, 2022

(54) FIXING BELT, FIXING DEVICE, AND IMAGE FORMING APPARATUS

(71) Applicant: FUJIFILM Business Innovation Corp., Tokyo (JP)

(72) Inventors: Ryohei Yoshikawa, Kanagawa (JP); Tomotake Inagaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/495,779

(22) Filed: Oct. 6, 2021

(65) Prior Publication Data

US 2022/0382197 A1 Dec. 1, 2022

(30) Foreign Application Priority Data

May 26, 2021 (JP) ..... JP2021-088682

(51) Int. Cl.
*G03G 15/20* (2006.01)

(52) U.S. Cl.
CPC ..... *G03G 15/2057* (2013.01); *G03G 15/2064* (2013.01); *G03G 2215/2038* (2013.01)

(58) Field of Classification Search
CPC ..... G03G 15/2017; G03G 15/2053; G03G 15/2057; G03G 2215/2003; G03G 2215/2016
See application file for complete search history.

(56) References Cited

U.S. PATENT DOCUMENTS

| | | | | |
|---|---|---|---|---|
| 8,445,090 | B2 | 5/2013 | Nakajima et al. | |
| 2006/0188300 | A1* | 8/2006 | Matsunaka | G03G 15/2053 399/333 |
| 2012/0170958 | A1* | 7/2012 | Nakajima | G03G 15/2053 399/333 |
| 2014/0255068 | A1* | 9/2014 | Matsunaka | G03G 15/2057 399/333 |
| 2021/0373473 | A1* | 12/2021 | Lee | B32B 25/08 |

FOREIGN PATENT DOCUMENTS

| | | |
|---|---|---|
| JP | 2011186127 | 9/2011 |
| JP | 2019140105 | 8/2019 |

* cited by examiner

*Primary Examiner* — Thomas S Giampaolo, II
(74) *Attorney, Agent, or Firm* — JCIPRNET

(57) ABSTRACT

A fixing belt includes, in the following order: a base material layer containing a resin; an elastic layer containing an elastic material; and a release layer, in which each of the base material layer and the elastic layer further contains an aggregate in which plural fibrous carbons are entangled with each other, a maximum diameter of the aggregate in the base material layer is 50% or less of a film thickness of the base material layer, and a maximum diameter of the aggregate in the elastic layer is 15% or less of a film thickness of the elastic layer.

20 Claims, 3 Drawing Sheets

FIXING BELT, FIXING DEVICE, AND IMAGE FORMING APPARATUS

CROSS-REFERENCE TO RELATED APPLICATIONS

This application is based on and claims priority under 35 USC 119 from Japanese Patent Application No. 2021-088682 filed May 26, 2021.

BACKGROUND

(i) Technical Field

The present invention relates to a fixing belt, a fixing device, and an image forming apparatus.

(ii) Related Art

For example, in an image forming apparatus using an electrophotographic method (such as a copier, a facsimile, and a printer), a fixing belt that fixes a toner image formed on a recording medium to the recording medium is used.

JP2019-140105A discloses a functional film containing an aggregate consisting of entangled carbon nanotubes and having a diameter of 50 μm or less, a height of less than 5 μm, and a ratio (height/diameter) of the height to the diameter of less than 0.1.

Further, JP2011-186127A discloses a polyimide tube in which carbon nanotubes are dispersed in a polyimide resin, as a needle-like high thermal conductive filler.

SUMMARY

Aspects of non-limiting embodiments of the present disclosure relate to a fixing belt that is applied to a fixing method in which a heat source is present inside the fixing belt and heat from the heat source is transferred to a toner image via the fixing belt, and may achieve a long life, as compared with a case where a base material layer and an elastic layer each only contain fibrous carbons that are not entangled with each other, as fibrous carbons or a case where the base material layer and the elastic layer each contain an aggregate in which plural fibrous carbons are entangled with each other and a maximum diameter of such aggregates does not satisfy the following relationship.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

As specific means, the following aspects are contained. According to an aspect of the present disclosure, there is provided a fixing belt including, in the following order: a base material layer containing a resin; an elastic layer containing an elastic material; and a release layer, in which each of the base material layer and the elastic layer further contains an aggregate in which a plurality of fibrous carbons are entangled with each other, a maximum diameter of the aggregate in the base material layer is 50% or less of a film thickness of the base material layer, and a maximum diameter of the aggregate in the elastic layer is 15% or less of a film thickness of the elastic layer.

BRIEF DESCRIPTION OF THE DRAWINGS

Exemplary embodiment(s) of the present invention will be described in detail based on the following figures, wherein.

DETAILED DESCRIPTION

Figure 1:
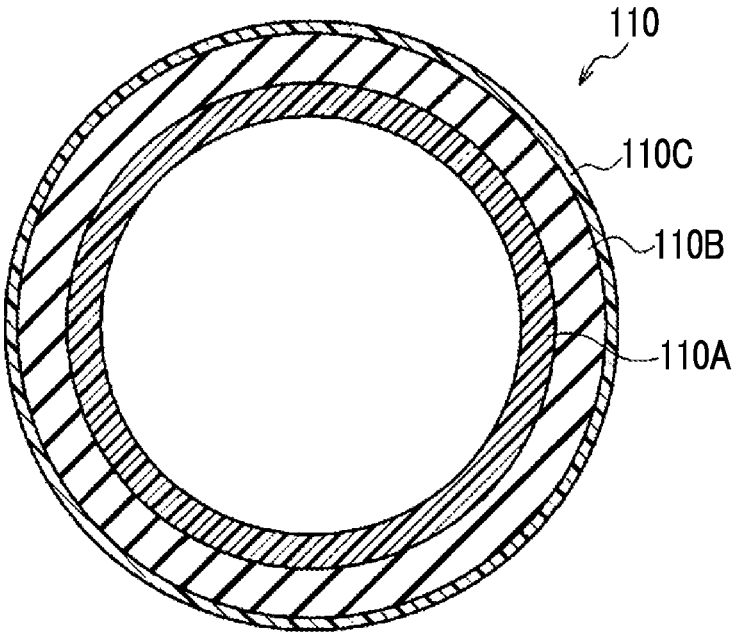
FIG. 1 is a schematic cross-sectional diagram showing an example of a fixing belt according to the present disclosure.

Hereinafter, exemplary embodiments of the present disclosure will be described. These descriptions and examples illustrate the exemplary embodiments and do not limit the scope of the exemplary embodiments.

In a numerical range described stepwise in the present specification, an upper limit value or a lower limit value described in one numerical range may be replaced with an upper limit value or a lower limit value of another numerical range described stepwise.

Further, in a numerical range described in the present specification, an upper limit value or a lower limit value of the numerical range may be replaced with a value shown in examples.

In the present specification, each component may contain plural kinds of substances corresponding thereto.

In a case where the amount of each component in a composition is mentioned in the present specification and plural kinds of substances corresponding to each component are present in the composition, unless otherwise specified, the amount means a total amount of the plural kinds of substances present in the composition.

Fixing Belt

A fixing belt according to the present disclosure includes, in the following order: a base material layer containing a resin; an elastic layer containing an elastic material; and a release layer, in which each of the base material layer and the elastic layer further contains an aggregate in which a plurality of fibrous carbons are entangled with each other, a maximum diameter of the aggregate in the base material layer is 50% or less of a film thickness of the base material layer, and a maximum diameter of the aggregate in the elastic layer is 15% or less of a film thickness of the elastic layer.

Hereinafter, the aggregate in which plural fibrous carbons are entangled with each other is appropriately referred to as a specific aggregate.

Examples of the fixing belt include a belt which is applied to a fixing method in which a heat source is present inside the fixing belt and heat from the heat source is transferred to a toner image via the fixing belt.

In the fixing belt applied to such a fixing method, the base material layer and the elastic layer often each contain a thermal conductive material. However, in a case where the heat transfer at an interface between the base material layer and the elastic layer is inefficient, in a case where heating is performed to be a set fixing temperature, a temperature of the heat source that heats the fixing belt may increase. In a case where the temperature of the heat source increases, deterioration of a lubricant existing between the heat source and the fixing belt is accelerated, and the belt may break due to an increase in torque.

In the fixing belt according to the present disclosure, both the base material layer and the elastic layer include, as an elastic material, the aggregate (that is, the specific aggregate) in which plural fibrous carbons are entangled with each other. It is considered that at an interface between the base material layer and the elastic layer each containing the specific aggregate, since a contact area between the specific aggregates becomes large due to a shape of the specific aggregates, the transfer of heat will be smooth, as compared with a case of containing fibrous carbons that are not entangled with each other.

Therefore, it is presumed that, in the fixing belt according to the present disclosure, in a case where the fixing belt is heated to the set fixing temperature, the temperature of the heat source that heats the fixing belt is suppressed from increasing, and the belt breakage is suppressed, and thus long life may be achieved.

Further, since in the fixing belt according to the present disclosure, heat may be smoothly transferred at the interface between the base material layer and the elastic layer as described above, the fixing belt may be applied to the fixing method in which the heat source is present inside the fixing belt and heat from the heat source is transferred to the toner image via the fixing belt.

The fixing belt according to the present disclosure will be described with reference to FIG. 1.

FIG. 1 is a schematic cross-sectional diagram showing an example of the fixing belt according to the present disclosure.

A fixing belt 110 shown in FIG. 1 includes a base material layer 110A, an elastic layer 110B provided on the base material layer 110A, and a release layer 110C provided on the elastic layer 110B.

The layer structure of the fixing belt 110 according to the present disclosure is not limited to the layer structure shown in FIG. 1, and may be a layer structure in which an adhesive layer is interposed between the elastic layer 110B and the release layer 110C.

Hereinafter, components of the fixing belt according to the present disclosure will be described in detail. The description will be made without reference numerals.

Base Material Layer

The base material layer of the fixing belt according to the present disclosure includes the resin and the aggregate (that is, the specific aggregate) in which plural fibrous carbons are entangled with each other.

A maximum diameter of the specific aggregate in the base material layer is 50% or less of a film thickness of the base material layer.

Specific Aggregate

The specific aggregate in the base material layer is used as a thermal conductive material.

As described above, the maximum diameter of the specific aggregate in the base material layer is, for example, 50% or less, preferably 40% or less, and more preferably 25% or less of the film thickness of the base material layer. On the other hand, the maximum diameter of the specific aggregate is, for example, more preferably 1% or more of the base material layer film thickness.

Further, from the viewpoints of facilitating a heat transfer at the interface between the base material layer and the elastic layer, the maximum diameter of the specific aggregate in the base material layer is, for example, preferably 0.5 μm or more and 60 μm or less, more preferably 1 μm or more and 40 μm or less, and still more preferably, 3 μm or more and 25 μm or less.

The specific aggregate in the base material layer may be an aggregate in which plural fibrous carbons are entangled with each other and which has the maximum diameter described above, and a shape thereof is not particularly limited. The specific aggregate in the belt may be, for example, spherical, elliptical spherical, or irregularly shaped.

Further, from the viewpoints of facilitating a heat transfer at the interface between the base material layer and the elastic layer, the ratio (minor axis Y/major axis X) of a minor axis Y to a major axis X of the specific aggregate in the base material layer is, for example, preferably 0.1 or more and 1 or less, more preferably 0.1 or more and 0.8 or less, and still more preferably 0.2 or more and 0.6 or less.

The maximum diameter, the major axis X, and the minor axis Y of the specific aggregate are measured by the following method.

The release layer and the elastic layer are peeled off from the fixing belt, and the measurement is performed using a surface scanning electron microscope (SEM) image of the exposed base material layer. For 10 random specific aggregates exposed on the surface, the length in the longitudinal direction and the length in the normal direction thereof are measured, and each arithmetic mean value of the 10 specific aggregates is set as a value of the maximum diameter (=major axis X) or the minor axis Y.

As a method of peeling the release layer and the elastic layer from the fixing belt, for example, the same method as a measurement of the thermal conductivity to be described later may be used.

The fibrous carbon contained in the specific aggregate in the base material layer has a length of, for example, preferably 0.5 μm or more and 100 μm or less, more preferably 2 μm or more and 80 μm or less, and still more preferably 3 μm or more and 60 μm or less.

The fibrous carbon contained in the specific aggregate in the base material layer has a diameter of, for example, preferably 20 nm or more and 300 nm or less, more preferably 25 nm or more and 250 nm or less, and still more preferably 30 nm or more and 200 nm or less.

The length and the diameter of the fibrous carbon contained in the specific aggregate are measured by the following method.

The release layer and the elastic layer are peeled off from the fixing belt, and the measurement is performed using a surface SEM image of the exposed base material layer. For 10 random fibrous carbons in the specific aggregate exposed on the surface, the length and grist (thickness) are measured, and each arithmetic mean value of the 10 fibrous carbons is set as a value of the length or the diameter.

As a method of peeling the release layer and the elastic layer from the fixing belt, for example, the same method as a measurement of the thermal conductivity to be described later may be used.

The number of the fibrous carbons contained in the specific aggregate may be plural (that is, two or more fibrous carbons), and is not particularly limited.

The fibrous carbons contained in the specific aggregate in the base material layer are, for example, preferably carbon nanotubes from the viewpoints of availability, thermal conductivity, and the like.

From the viewpoints of further facilitating a heat transfer at the interface between the base material layer and the elastic layer, a content A1 of the specific aggregate in the base material layer is, for example, preferably 0.1% by mass or more and 20% by mass or less, more preferably 1% by mass or more and 18% by mass or less, still more preferably 2% by mass or more and 15% by mass or less, and particularly preferably 5% by mass or more and 15% by mass or less, with respect to a total mass of the base material layer.

Fibrous Carbons that are not Entangled with Each Other

For example, the base material layer preferably contains fibrous carbons that are not entangled with each other, in addition to the specific aggregates described above, from the viewpoint of further increasing the thermal conductivity.

That is, for example, the base material layer preferably contains the resin, the specific aggregate, and the fibrous carbons that are not entangled with each other.

In the base material layer, the fibrous carbons that are not entangled with each other each have a length of, for example, preferably 1 μm or more and 100 μm or less, more preferably 2 μm or more and 80 μm or less, and still more preferably 3 μm or more and 60 μm or less.

In the base material layer, the fibrous carbons that are not entangled with each other each have a diameter of, for example, preferably 20 nm or more and 300 nm or less, more preferably 25 nm or more and 250 nm or less, and still more preferably 30 nm or more and 200 nm or less.

In the base material layer, the fibrous carbons that are not entangled with each other may be the same as or different from fibrous carbons contained in the specific aggregate (that is, the fibrous carbons configuring the specific aggregate).

In the base material layer, the fibrous carbons that are not entangled with each other are, for example, preferably carbon nanotubes from the viewpoints of availability, thermal conductivity, and the like.

In a case where the base material layer contains the fibrous carbons that are not entangled with each other, a content thereof is, for example, preferably more than 0% by mass and not more than 15% by mass or less, more preferably 0.5% by mass or more and 10% by mass or less, still more preferably 1% by mass or more and 10% by mass or less, and particularly preferably 1% by mass or more and 5% by mass or less, with respect to a total mass of the base material layer.

In the base material layer, from the viewpoint of increasing the thermal conductivity of the base material layer, for example, it is preferable that a content A of the specific aggregate and a content B of the fibrous carbons that are not entangled with each other satisfy a relationship of $A \geq B$ on a mass basis.

Further, from the viewpoint of increasing the thermal conductivity of the base material layer, in the base material layer, for example, it is preferable that a ratio (A/(A+B)) of a content A of the specific aggregate to a total amount of the content A of the aggregate and a content B of the fibrous carbons that are not entangled with each other is, for example, preferably 0.50 or more and 0.95 or less and more preferably 0.50 or more and 0.90 or less on a mass basis.

The content A of the specific aggregate and the content B of the fibrous carbons that are not entangled with each other are measured by the following method.

The release layer and the elastic layer are peeled off from the fixing belt, and the contents are measured by an image analysis of a surface SEM image of the exposed base material layer. A total area of the specific aggregates and a total area of the fibrous carbons that are not entangled with each other in the surface area of the exposed base material layer are determined by image analysis of the surface SEM image. Here, the number of measurement samples (that is, the number of SEM images to be image-analyzed) is 5. The "content A of the specific aggregate" is the arithmetic mean value of the 5 samples of the "total area of the specific aggregates in the surface area of the base material layer" determined by the above method. Also, the "content B of the fibrous carbons that are not entangled with each other" is the arithmetic mean value of 5 samples of the "total area of the fibrous carbons that are not entangled with each other, in the surface area of the base material layer" determined by the above method.

Moreover, the ratio (A/(A+B)) is calculated from the "content A of the specific aggregate" and the "content B of the fibrous carbons that are not entangled with each other" obtained as described above. In a case of calculating the ratio (A/(A+B)), in a case where the specific aggregate and the fibrous carbons that are not entangled with each other have different specific gravities, the content A and the content B may be corrected using the respective specific gravities.

As a method of peeling the release layer and the elastic layer from the fixing belt, for example, the same method as a measurement of the thermal conductivity to be described later may be used.

Resin

The resin contained in the base material layer is, for example, preferably a heat-resistant resin.

Examples of the resin include a heat-resistant resin or the like with high heat resistance and high strength, such as a liquid crystal material such as polyimide, aromatic polyamide, and a thermotropic liquid crystal polymer. Polyester, polyethylene terephthalate, polyethersulfone, polyetherketone, polysulfone, polyimideamide, and the like are used in addition to the resins.

Among these, as the resin, for example, the polyimide is preferable.

Examples of the polyimide include an imidized product of a polyamic acid (precursor of a polyimide resin) which is a polymer of a tetracarboxylic acid dianhydride and a diamine compound. Specific examples of the polyimide include a resin obtained by polymerizing equimolar amounts of the tetracarboxylic acid dianhydride and the diamine compound in a solvent to obtain a polyamic acid solution, and then imidizing the polyamic acid.

Examples of the tetracarboxylic acid dianhydride include both an aromatic compound and an aliphatic compound. From the viewpoint of heat resistance, for example, the aromatic compound is preferable.

Examples of the aromatic tetracarboxylic acid dianhydride include pyromellitic acid dianhydride, 3,3',4,4'-benzophenone tetracarboxylic acid dianhydride, 3,3',4,4'-biphenyl sulfone tetracarboxylic acid dianhydride, 1,4,5,8-naphthalene tetracarboxylic acid dianhydride, 2,3,6,7-naphthalene tetracarboxylic acid dianhydride, 3,3',4,4'-biphenyl ether tetracarboxylic acid dianhydride, 3,3',4,4'-dimethyldiphenylsilane tetracarboxylic acid dianhydride, 3,3',4,4'-tetraphenylsilane tetracarboxylic acid dianhydride, 1,2,3,4-furantetracarboxylic acid dianhydride, 4,4'-bis(3,4-dicarboxyphenoxy) diphenylsulfide dianhydride, 4,4'-bis(3,4-dicarboxyphenoxy) diphenylsulfone dianhydride, 4,4'-bis(3,4-dicarboxyphenoxy) diphenylpropane dianhydride, 3,3',4,4'-perfluoroisopropylidene diphthalic acid dianhydride, 3,3',4,4'-biphenyl tetracarboxylic acid dianhydride, 2,3,3',4'-biphenyl tetracarboxylic acid dianhydride, bis(phthalic acid) phenylphosphine oxide dianhydride, p-phenylene-bis(triphenylphthalic acid) dianhydride, m-phenylene-bis(triphenylphthalic acid) dianhydride, bis(triphenylphthalic acid)-4,4'-diphenyl ether dianhydride, and bis(triphenylphthalic acid)-4,4'-diphenyl methane dianhydride.

Examples of the aliphatic tetracarboxylic acid dianhydride include an aliphatic or alicyclic tetracarboxylic acid dianhydride such as butanetetracarboxylic acid dianhydride, 1,2,3,4-cyclobutanetetracarboxylic acid dianhydride, 1,3-dimethyl-1,2,3,4-dyclobutanetetracarboxylic acid dianhydride, 1,2,3,4-cyclopentanetetracarboxylic acid dianhydride, 2,3,5-tricarboxycyclopentylacetic acid dianhydride, 3,5,6-tricarboxyorbornane-2-acetic acid dianhydride, 2,3,4,5-tetrahydrofuran tetracarboxylic acid dianhydride, 5-(2,5-dioxotetrahydrofuryl)-3-methyl-3-cyclohexene-1,2-dicarboxylic acid dianhydride, and bicyclo[2,2,2]-oct-7-ene-2,3,5,6-tetracarboxylic acid dianhydrides; and an aliphatic tetracarboxylic dianhydride having an aromatic ring such as 1,3,3a,4,5,9b-hexahydro-2,5-dioxo-3-furanyl)-naphtho[1,2-c]furan-1,3-dione, 1,3,3a,4,5,9b-hexahydro-5-methyl-5-(tetrahydro-2,5-dioxo-3-furanyl)-naphtho[1,2-c]furan-1,3-dione, and 1,3,3a,4,5,9b-hexahydro-8-methyl-5-(tetrahydro-2,5-dioxo-3-furanyl)-naphtho[1,2-c]furan-1,3-dione.

Among these, as the tetracarboxylic acid dianhydride, the aromatic tetracarboxylic acid dianhydride may be used. Specifically, for example, the pyromellitic acid dianhydride, the 3,3',4,4'-biphenyl tetracarboxylic acid dianhydride, the 2,3,3',4'-biphenyl tetracarboxylic acid dianhydride, the 3,3',4,4'-biphenyl ether tetracarboxylic acid dianhydride, and the 3,3',4,4'-benzophenone tetracarboxylic acid dianhydride may be used. Further, pyromellitic acid dianhydride, the 3,3',4,4'-biphenyl tetracarboxylic acid dianhydride, and the 3,3',4,4'-benzophenone tetracarboxylic acid dianhydride may be used. In particular, the 3,3',4,4'-biphenyl tetracarboxylic acid dianhydride may be used.

The tetracarboxylic acid dianhydride may be used alone or two or more kinds thereof may be used in combination.

Further, in a case where two or more kinds of the tetracarboxylic acid dianhydrides are used in combination, each of the aromatic tetracarboxylic acid dianhydrides and the aliphatic tetracarboxylic acid dianhydrides may be used in combination, and the aromatic tetracarboxylic acid dianhydride and the aliphatic tetracarboxylic acid dianhydride may be combined.

On the other hand, the diamine compound is a diamine compound having two amino groups in a molecular structure. Examples of the diamine compound include both an aromatic compound and an aliphatic compound, and for example, the aromatic compound is preferable.

Examples of the diamine compound include an aromatic diamine such as p-phenylenediamine, m-phenylenediamine, 4,4'-diaminodiphenylmethane, 4,4'-diaminodiphenylethane, 4,4'-diaminodiphenyl ether, 4,4'-diaminodiphenyl sulfide, 4,4'-diaminodiphenyl sulfone, 1,5-diaminonaphthalene, 3,3-dimethyl-4,4'-diaminobiphenyl, 5-amino-1-(4'-aminophenyl)-1,3,3-trimethylindane, 6-amino-1-(4'-aminophenyl)-1,3,3-trimethylindane, 4,4'-diaminobenzanilide, 3,5-diamino-3'-trifluoromethylbenzanilide, 3,5-diamino-4'-trifluoromethylbenzanilide, 3,4'-diaminodiphenyl ether, 2,7-diaminofluorene, 2,2-bis(4-aminophenyl) hexafluoropropane, 4,4'-methylene-bis(2-chloroaniline), 2,2', 5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl)biphenyl, 2,2-bis[4-(4-aminophenoxy)phenyl]propane, 2,2-bis[4-(4-aminophenoxy)phenyl]hexafluoropropane, 1,4-bis(4-aminophenoxy)benzene, 4,4'-bis(4-aminophenoxy)-biphenyl, 1,3'-bis(4-aminophenoxy)benzene, 9,9-bis(4-aminophenyl)fluorene, 4,4'-(p-phenylene isopropylidene) bisaniline, 4,4'-(m-phenylene isopropylidene)bisaniline, 2,2'-bis[4-(4-amino-2-trifluoromethylphenoxy)phenyl] hexafluoropropane, and 4,4'-bis[4-(4-amino-2-trifluoromethyl)phenoxy]-octafluorobiphenyl; an aromatic diamine, having two amino groups bonded to an aromatic ring and a hetero atom other than a nitrogen atom of the amino groups, such as diaminotetraphenylthiophene; and an aliphatic diamine and an alicyclic diamine such as 1,1-m-xylylenediamine, 1,3-propane diamine, tetramethylenediamine, pentamethylenediamine, octamethylenediamine, nonamethylenediamine, 4,4-diaminoheptamethylenediamine, 1,4-diaminocyclohexane, isophorone diamine, tetrahydrodicyclopentadienylenediamine, hexahydro-4,7-methanoin danylene dimethylenediamine, tricyclo[6,2,1,$0^{2,7}$]-undecylenic methyldiamine, and 4,4'-methylene bis(cyclohexylamine).

Among these, as the diamine compound, the aromatic diamine compound may be used. Specifically, for example, the p-phenylenediamine, the m-phenylenediamine, the 4,4'-diaminodiphenylmethane, the 4,4'-diaminodiphenyl ether, the 3,4'-diaminodiphenyl ether, the 4,4'-diaminodiphenyl sulfide, and the 4,4'-diaminodiphenyl sulfone may be used. In particular, the 4,4'-diaminodiphenyl ether and the p-phenylenediamine may be used.

The diamine compound may be used alone or two or more kinds thereof may be used in combination.

In addition, in a case where two or more kinds of the diamine compound are used in combination, each of the aromatic diamine compounds and the aliphatic diamine compounds may be used in combination, and the aromatic diamine compound and the aliphatic diamine compound may be combined.

Among these, from the viewpoint of heat resistance, the polyimide is, for example, preferably the aromatic polyimide (specifically, an imidized product of a polyamic acid (precursor of a polyimide resin) which is a polymer of an aromatic tetracarboxylic acid dianhydride and an aromatic diamine compound.

The aromatic polyimide is, for example, more preferably a polyimide having a structural unit represented by the following General Formula (PI1).

(PI1)

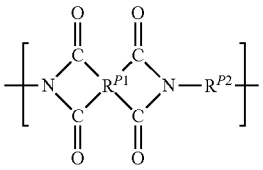

In General Formula (PI1), $R^{P1}$ represents a phenyl group or a biphenyl group, and $R^{P2}$ represents a divalent aromatic group.

Examples of the divalent aromatic group represented by $R^{P2}$ include a phenylene group, a naphthyl group, a biphenyl group, and a diphenyl ether group. From the viewpoint of bending durability, as the divalent aromatic group, for example, the phenylene group and the biphenyl group are preferable.

The number average molecular weight of the polyimide may be 5,000 or more and 100,000 or less, for example, more preferably 7,000 or more and 50,000 or less, and still more preferably 10,000 or more and 30,000 or less.

The number average molecular weight of the polyimide is measured by a gel permeation chromatography (GPC) method under the following measurement conditions.

Column: Tosoh TSK gel α-M (7.8 mm ID×30 cm)

Eluent: DMF (dimethylformamide)/30 mM LiBr/60 mM phosphoric acid

Flow velocity: 0.6 mL/min

Injection amount: 60 μL

Detector: RI (differential refractive index detector)

The content of the resin in the base material layer is, for example, preferably 80% by mass or more, more preferably 85% by mass or more, and still more preferably 90% by mass or more, with respect to the total mass of the base material layer.

Additive

The fixing belt according to the present disclosure may include a well-known additive such as a filler and a lubricant, in addition to the resin, the specific aggregate, and the fibrous carbons that are not entangled with each other.

The film thickness of the base material layer is, for example, preferably 30 μm or more and 200 μm or less, more preferably 50 μm or more and 150 μm or less, and particularly preferably 70 μm or more and 120 μm or less, from the viewpoints of thermal conductivity and mechanical strength.

Physical Property

Thermal Conductivity

The thermal conductivity of the base material layer is, for example, preferably 0.5 W/m·K or more and 10 W/m·K or less, more preferably 0.6 W/m·K or more and 10 W/m·K or less, and still more preferably 0.8 W/m·K or more and 10 W/m·K or less.

The thermal conductivity of the base material layer is measured as follows.

First, from a surface layer side of the fixing belt, a cutter blade is inserted into an elastic layer/base material layer interface, the blade is advanced in a horizontal direction with respect to the interface, and the base material layer is scraped off to peel off the elastic layer and the release layer from the base material layer.

The thermal conductivity of the obtained layer to be measured is measured under a condition of a load of 50 g by a temperature wave analysis method using ai-phase (manufactured by ai-Phase Co.).

Tensile Elongation

In addition, the tensile elongation of the base material layer is, for example, preferably 5% or more and 40% or less, more preferably 7% or more and 40% or less, and still more preferably 10% or more and 40% or less.

The tensile elongation of the base material layer is measured as follows.

First, the base material layer and the release layer are peeled off from the fixing belt in the same manner as in the measurement of the thermal conductivity.

First, a dumbbell-shaped test piece having a constriction width of 5 mm is cut out from the obtained base material layer. The sample piece is subjected to a tensile test at a speed of 10 mm/min using a load tester (manufactured by Aikoh Engineering Co., Ltd.), and the tensile elongation is determined from an elongation when the test piece breaks.

Formation of Base Material Layer

A base material layer-forming coating liquid containing a resin and an additive to be used as needed is prepared, and the obtained base material layer-forming coating liquid is applied onto a cylindrical base material, and dried to obtain the base material layer. The base material layer-forming coating liquid contains a resin, a specific aggregate, other components used as necessary (such as fibrous carbons that are not entangled with each other and an additive), and the like.

In a case where the resin is polyimide, a base material layer-forming coating liquid containing a polyamic acid (precursor of a polyimide resin) and an additive to be used as needed is prepared, and the obtained base material layer-forming coating liquid is applied onto a cylindrical base material and is fired (that is, imidized) to obtain the resin base material layer.

In a case of preparing the base material layer-forming coating liquid, for example, the specific aggregate is preferably manufactured as well.

Specifically, examples of the method include a method in which a precursor liquid containing a resin and a fibrous carbon is prepared (also referred to as a precursor liquid preparation step), a specific aggregate is produced in a system of the precursor liquid (also referred to as a specific aggregate production step), and the base material layer-forming coating liquid containing the resin and the specific aggregate is obtained.

Hereinafter, the precursor liquid preparation step and the specific aggregate production step will be described.

Precursor Liquid Preparation Step

In the precursor liquid preparation step, first, the fibrous carbon and a dispersion medium are mixed to prepare a dispersion liquid in which the fibrous carbons are dispersed.

Here, examples of the dispersion medium include an organic solvent that does not dissolve or is difficult to dissolve the fibrous carbon, and can dissolve the resin. For example, in a case where a polyamic acid (precursor of a polyimide resin) is used as the resin, examples of the dispersion medium include N-methyl-2-pyrrolidone (NMP), dimethyl sulfoxide (DMSO), and 1,3-dimethyl-2-imidazolidinone (DMI).

Here, the content of fibrous carbon in the dispersion liquid is 0.1% by mass or more and 10% by mass or less (for example, preferably 0.3% by mass or more and 5% by mass or less) with respect to the total mass of the dispersion liquid.

The obtained dispersion liquid is, for example, preferably subjected to a high-pressure dispersion treatment. By performing the high-pressure dispersion treatment, the fibrous carbon is loosened in the dispersion liquid and isolated individually, and further the length of the fibrous carbon in the dispersion liquid is adjusted.

Here, the conditions for the high-pressure dispersion treatment may be any condition under which the fibrous carbons are individually isolated and the length of the fibrous carbons may be adjusted to a target value. For example, the high-pressure dispersion treatment is preferably performed at a liquid temperature of the dispersion liquid of 30° C. or higher and 60° C. or lower and under a pressure of 20 MPa or more and 100 MPa or less (for example, preferably 40 MPa or higher and 80 MPa or lower).

A high-pressure homogenizer is used for the high-pressure dispersion treatment.

The length of the fibrous carbon in the dispersion liquid is adjusted to, for example, preferably about 1 μm or more and 100 μm or less (for example, preferably 3 μm or more and 50 μm or less).

Here, the length of the fibrous carbon in the dispersion liquid may be measured by observation with an optical microscope or an electron microscope.

The maximum diameter of the specific aggregate may be controlled by the length of the fibrous carbon in the dispersion liquid. Specifically, as the fibrous carbon is longer, the aggregate having a larger maximum diameter tends to be produced.

In the precursor liquid preparation step, a resin is subsequently added to the dispersion liquid obtained as described above to prepare a precursor liquid.

The amount of the resin added is, for example, preferably set to about 1% by mass or more and 20% by mass or less (for example, preferably 3% by mass or more and 15% by mass or less) with respect to the total mass of the dispersion liquid.

Specific Aggregate Manufacturing Step

In the specific aggregate manufacturing step, the precursor liquid obtained in the precursor liquid preparation step is agitated with a planetary mixer to manufacture a specific aggregate in the system.

By agitating the precursor liquid with a planetary mixer, the fibrous carbons individually isolated in the precursor liquid are slowly entangled into a lump, and a specific aggregate is produced.

Here, a condition of agitating by the planetary mixer may be a condition under which a specific aggregate having a target maximum diameter may be obtained.

For example, as the condition of agitating, for example, it is preferable that the liquid temperature of the precursor liquid is 25° C. or higher and 40° C. or lower, and the agitating is performed for 10 minutes or longer and 60 minutes or shorter.

The maximum diameter of the specific aggregate may be controlled by the condition of agitating. Specifically, as the time for agitating by the planetary mixer is longer, the aggregate having a larger maximum diameter tends to be produced.

In the specific aggregate production step, all of the fibrous carbons contained in the precursor liquid may become specific aggregates, and together with the specific aggregates, some of the fibrous carbons which do not form the specific aggregates (that is, the fibrous carbons that are not entangled with each other) may remain.

As described above, a mixture liquid containing the resin and the specific aggregate may be obtained.

By adding other components (such as fibrous carbons that are not entangled with each other and an additive) to the obtained mixture liquid, as needed, a base material layer-forming coating liquid may be obtained. Further, the obtained mixture liquid may be diluted with an organic solvent to adjust viscosity or the like of the coating liquid.

Elastic Layer

The base material layer of the fixing belt according to the present disclosure includes the elastic material and the aggregate (that is, the specific aggregate) in which plural fibrous carbons are entangled with each other.

A maximum diameter of the specific aggregate in the elastic layer is 15% or less of a film thickness of the elastic layer.

Specific Aggregate

The specific aggregate in the elastic layer is used as a thermal conductive material.

As described above, the maximum diameter of the specific aggregate in the elastic layer is, for example, preferably 15% or less, and more preferably 10% or less of the film thickness of the elastic layer. On the other hand, the maximum diameter of the specific aggregate is, for example, more preferably 2% or more of the film thickness of the elastic layer.

Further, from the viewpoints of facilitating a heat transfer at the interface between the base material layer and the elastic layer, the maximum diameter of the specific aggregate in the elastic layer is, for example, preferably 60 μm or less, and more preferably 30 μm or less.

The lower limit of the maximum diameter of the specific aggregate in the elastic layer is, for example, 5 μm or more.

The specific aggregate used in the elastic layer has the same maximum diameter or the like as the maximum diameter or the like of the specific aggregate used in the base material layer, unless otherwise specified, and an aspect thereof is also the same.

from the viewpoints of further facilitating a heat transfer at the interface between the base material layer and the elastic layer, a content A2 of the specific aggregate in the elastic layer is, for example, preferably 0.1% by mass or more and 40% by mass or less, more preferably 1% by mass or more and 35% by mass or less, still more preferably 5% by mass or more and 30% by mass or less, and particularly preferably 15% by mass or more and 25% by mass or less, with respect to a total mass of the elastic layer.

In the fixing belt according to the present disclosure, for example, it is preferable that the content A1 of the specific aggregate contained in the base material layer and a content A2 of the aggregate contained in the elastic layer satisfy a relationship of $A1 \leq A2$ on a mass basis.

Further, in the fixing belt according to the present disclosure, for example, it is preferable that the relationship of $A1 \leq A2$ is satisfied, and the content A1 of the specific aggregate is 0.1% by mass or more and 20% by mass with respect to the total mass of the base material layer, and the content A2 of the specific aggregate is 0.1% by mass or more and 40% by mass or less with respect to the total mass of the elastic layer.

On the other hand, from the viewpoint of belt temperature stability during continuous paper passing for a long time, the content A1 of the specific aggregate contained in the base material layer and the content A2 of the specific aggregate contained in the elastic layer may satisfy a relationship of $A1 > A2$ on a mass basis.

Fibrous Carbons that are not Entangled with Each Other

For example, the elastic layer preferably contains fibrous carbons that are not entangled with each other, in addition to the specific aggregates described above, from the viewpoint of further increasing the thermal conductivity.

That is, for example, the elastic layer preferably contains the elastic material, the specific aggregate, and the fibrous carbons that are not entangled with each other.

Here, the fibrous carbons that are not entangled with each other, used for the elastic layer is the same as the fibrous carbons that are not entangled with each other, used for the base material layer, and an aspect thereof is also the same.

In a case where the elastic layer contains the fibrous carbons that are not entangled with each other, a content thereof is, for example, preferably more than 0% by mass and not more than 20% by mass, more preferably more than 0.1% by mass and not more than 15% by mass, still more preferably 0.3% by mass or more and 10% by mass or less, and particularly preferably 0.5% by mass or more and 8% by mass or less, with respect to a total mass of the elastic layer.

Even in the elastic layer, for example, it is preferable that the content A of the specific aggregate and the content B of the fibrous carbons that are not entangled with each other satisfy a relationship of $A \geq B$ on a mass basis.

Further, in the elastic layer, a ratio $(A/(A+B))$ of a content A of the specific aggregate to a total amount of the content A of the aggregate and a content B of the fibrous carbons that are not entangled with each other is, for example, preferably 0.50 or more and 0.95 or less and more preferably 0.75 or more and 0.95 or less on a mass basis.

Elastic Material

Examples of the elastic material contained in the elastic layer include a fluororesin, a silicone resin, a silicone rubber, a fluororubber, and a fluorosilicone rubber. Among these, as the elastic material, for example, the silicone rubber and the fluororubber are preferable, and the silicone rubber is more preferable, from the viewpoints of heat resistance, thermal conductivity, insulation, and the like.

Examples of the silicone rubber include RTV silicone rubber, HTV silicone rubber, and liquid silicone rubber. Specific examples thereof include polydimethyl silicone rubber (MQ), methyl vinyl silicone rubber (VMQ), methylphenyl silicone rubber (PMQ), and fluorosilicone rubber (FVMQ).

As the silicone rubber, for example, it is preferable to use a silicone rubber in which most of crosslinking-forms are addition reaction type. In addition, various types of functional groups are known for the silicone rubber. For example, dimethyl silicone rubber having a methyl group, methylphenyl silicone rubber having a methyl group and a phenyl group, and vinyl silicone rubber having a vinyl group (vinyl group-containing silicone rubber) are preferably used.

Further, as the silicone rubber, for example, a vinyl silicone rubber having a vinyl group is more preferable. For example, a silicone rubber having an organopolysiloxane structure having a vinyl group and a hydrogen organopolysiloxane structure having a hydrogen atom (SiH) bonded to a silicon atom is still more preferable.

Examples of the fluororubber include vinylidene fluoride rubber, ethylene/propylene tetrafluoride rubber, ethylene/perfluoromethyl tetrafluoride vinyl ether rubber, phosphazene rubber, and fluoropolyether.

The elastic material contains, for example, preferably silicone rubber as a major component (that is, contains 50% by mass or more of silicone rubber with respect to the total mass of the elastic material).

The content of the silicone rubber is, for example, more preferably 90% by mass or more, still more preferably 99% by mass or more, and may also be 100% by mass, with respect to the total mass of the elastic material used for the elastic layer.

The content of the elastic material in the elastic layer is, for example, preferably 60% by mass or more, more preferably 70% by mass or more, and still more preferably 80% by mass or more, with respect to the total mass of the elastic layer.

Additive

The elastic layer may contain an additive, other than the components described above, such as an inorganic filler, a softening agent (such as a paraffin-based agent), a processing aid (such as stearic acid), an anti-aging agent (such as an amine-based agent), and a vulcanizing agent (such as sulfur, an metal oxide, and a peroxide), in addition to the specific aggregate and the fibrous carbons.

The thickness (film thickness) of the elastic layer is, for example, preferably 30 μm or more and 600 μm or less, and more preferably 100 μm or more and 500 μm or less.

Physical Property

Thermal Conductivity

The thermal conductivity of the elastic layer is, for example, preferably 1.0 W/m·K or more and 4.5 W/m·K or less, more preferably 2.0 W/m·K or more and 4.5 W/m·K or less, and still more preferably 3.5 W/m·K or more and 4.5 W/m·K or less.

The thermal conductivity of the elastic layer is measured as follows.

First, after a notch is made with a cutter blade from a release layer side of the fixing belt to a release layer/elastic layer interface, the elastic layer is peeled off by grasping only the release layer by hand and pulling the elastic layer in a radial direction while rotating the belt. Thereafter, a cutter blade is inserted into the elastic layer/base material layer interface, and the blade is advanced in a horizontal direction with respect to the interface to peel off the base material layer.

The thermal conductivity of the elastic layer of the obtained subject is measured under a condition of a load of 50 g by a temperature wave analysis method using ai-phase (manufactured by ai-Phase Co.).

Young's Modulus

The elastic layer has a Young's modulus of, for example, preferably 0.2 MPa or more and 1.0 MPa or less, more preferably 0.2 MPa or more and 0.8 MPa or less, and still more preferably 0.2 MPa or more and 0.6 MPa or less.

The Young's modulus of the elastic layer is measured as follows.

First, the base material layer and the release layer are peeled off from the fixing belt in the same manner as in the measurement of the thermal conductivity.

Measurement is performed on the obtained elastic layer of the target with RHEOVIBRON (manufactured by ORIENTEC CO., LTD.) at an amplitude of 50 μm and a frequency of 10 Hz, and a value at 150° C. is used.

Formation of Elastic Layer

A known method may be applied to form the elastic layer, for example, a coating method is applied.

In a case where the silicone rubber is used as the elastic material of the elastic layer, for example, first, an elastic layer-forming coating liquid containing a liquid silicone rubber that is cured by heating to become a silicone rubber is prepared. Next, the elastic layer-forming coating liquid is applied onto the base material layer to form a coating film, and as needed, the coating film is vulcanized to form an elastic layer on the base material layer. In the vulcanization of the coating film, the vulcanization temperature is, for example, 150° C. or higher and 250° C. or lower, and the vulcanization time is, for example, 30 minutes or longer and 120 minutes or shorter.

In a case of preparing the elastic layer-forming coating liquid, for example, the specific aggregate is preferably manufactured as well.

Specifically, examples of the method include a method in which a precursor liquid containing an elastic material and a fibrous carbon is prepared (also referred to as a precursor liquid preparation step), a specific aggregate is produced in a system of the precursor liquid (also referred to as a specific aggregate production step), and the coating liquid containing the elastic material and the specific aggregate is obtained.

Here, the precursor liquid preparation step and the specific aggregate production step will be described.

Precursor Liquid Preparation Step

In the precursor liquid preparation step, first, the fibrous carbon and a dispersion medium are mixed to prepare a dispersion liquid in which the fibrous carbons are dispersed.

Here, examples of the dispersion medium include an organic solvent that does not dissolve or is difficult to dissolve the fibrous carbon, and can dissolve the elastic material. For example, in a case where the silicone rubber is used as the elastic material, examples of the dispersion medium include butyl acetate, toluene, heptane, benzene, and acetone.

Here, the content of fibrous carbon in the dispersion liquid is 10% by mass or more and 40% by mass or less (for example, preferably 15% by mass or more and 30% by mass or less) with respect to the total mass of the dispersion liquid.

The obtained dispersion liquid is, for example, preferably subjected to a high-pressure dispersion treatment. By performing the high-pressure dispersion treatment, the fibrous carbon is loosened in the dispersion liquid and isolated individually, and further the length of the fibrous carbon in the dispersion liquid is adjusted.

Here, the conditions for the high-pressure dispersion treatment may be any condition under which the fibrous carbons are individually isolated and the length of the fibrous carbons may be adjusted to a target value. For example, the high-pressure dispersion treatment is preferably performed at a liquid temperature of the dispersion liquid of 30° C. or higher and 60° C. or lower and under a pressure of 20 MPa or more and 100 MPa or less (for example, preferably 40 MPa or higher and 80 MPa or lower).

For example, a high-pressure homogenizer is used for the high-pressure dispersion treatment.

The length of the fibrous carbon in the dispersion liquid is adjusted to about 1.5 μm or more and 18 μm or less (for example, preferably 2 μm or more and 15 μm or less).

Here, the length of the fibrous carbon in the dispersion liquid may be measured by observation with an optical microscope or an electron microscope.

The maximum diameter of the specific aggregate may be controlled by the length of the fibrous carbon in the dispersion liquid. Specifically, as the fibrous carbon is longer, the aggregate having a larger maximum diameter tends to be produced.

In the precursor liquid preparation step, an elastic material is subsequently added to the dispersion liquid obtained as described above to prepare a precursor liquid.

The amount of the elastic material added is about 10% by mass or more and 90% by mass or less (for example, preferably 15% by mass or more and 60% by mass or less) with respect to the total mass of the precursor liquid.

Specific Aggregate Manufacturing Step

In the specific aggregate manufacturing step, the precursor liquid obtained in the precursor liquid preparation step is agitated with a planetary mixer to manufacture a specific aggregate in the system.

By agitating the precursor liquid with a planetary mixer, the fibrous carbons individually isolated in the precursor liquid are slowly entangled into a lump, and a specific aggregate is produced.

Here, a condition of agitating by the planetary mixer may be a condition under which a specific aggregate having a target maximum diameter may be obtained.

For example, as the condition of agitating, for example, the liquid temperature of the precursor liquid is 25° C. or higher and 40° C. or lower, and the agitating is, for example, preferably performed for 10 minutes or longer and 60 minutes or shorter while performing vacuuming.

The maximum diameter of the specific aggregate may be controlled by the condition of agitating. Specifically, as the time for agitating by the planetary mixer is longer, the aggregate having a larger maximum diameter tends to be produced.

In the specific aggregate production step, all of the fibrous carbons contained in the precursor liquid may become specific aggregates, and together with the specific aggregates, some of the fibrous carbons which do not form the specific aggregates (that is, the fibrous carbons that are not entangled with each other) may remain.

As described above, a mixture liquid containing the elastic material and the specific aggregate may be obtained.

By adding other components (such as fibrous carbons that are not entangled with each other and an additive) to the obtained mixture liquid, as needed, an elastic layer-forming coating liquid may be obtained. Further, the obtained mixture liquid may be diluted with an organic solvent to adjust viscosity or the like of the coating liquid.

Release Layer

The fixing belt according to the present disclosure has the release layer on the elastic layer.

The release layer is a layer that plays a role of suppressing the toner image in a molten state from sticking to the surface (outer peripheral surface) on a side in contact with the recording medium at the time of fixing.

The release layer is required to have, for example, heat resistance and releasability. From the viewpoint, for the material configuring the release layer, for example, a heat-resistant release material is preferably used, and specific examples thereof include fluororubber, fluororesin, silicone resin, and polyimide resin.

Among these, for example, the fluororesin may be used as the heat-resistant release material.

Specific examples of the fluororesin include a tetrafluoroethylene-perfluoroalkyl vinyl ether copolymer (PFA), polytetrafluoroethylene (PTFE), a tetrafluoroethylene-hexafluoropropylene copolymer (FEP), a polyethylene-tetrafluoro ethylene copolymer (ETFE), polyvinylidene fluoride (PVDF), polychlorotrifluoroethylene (PCTFE), and vinyl fluoride (PVF).

The surface of the release layer on the elastic layer side may be subjected to a surface treatment. The surface treatment may be a wet treatment or a dry treatment, and examples thereof include a liquid ammonia treatment, an excimer laser treatment, and a plasma treatment.

The thickness of the release layer is, for example, preferably 10 μm or more and 100 μm or less, and more preferably 20 μm or more and 50 μm or less.

A known method may be applied to form the release layer, and for example, a coating method may be applied.

Further, the release layer may be formed by preparing a tubular surface layer in advance and coating the outer periphery of the elastic layer with the release layer. An adhesive layer (for example, an adhesive layer containing a silane coupling agent having an epoxy group) may be formed on an inner surface of the tubular release layer and then the outer periphery may be coated therewith.

The film thickness of the fixing belt according to the present disclosure is, for example, preferably 0.06 mm or more and 0.90 mm or less, more preferably 0.15 mm or more and 0.70 mm or less, and further preferably 0.10 mm or more and 0.60 mm or less.

Use of Fixing Belt Member

The fixing belt according to the present disclosure is applied to both a heating belt and a pressure belt, and for example, as described above, is preferably applied to the fixing method in which the heat source is present inside the fixing belt and heat from the heat source is transferred to the toner image via the fixing belt.

Fixing Device

The fixing device according to the present disclosure has various configurations, for example, may include a fixing device including a first rotating body and a second rotating body arranged in contact with the outer surface of the first rotating body, in which a toner image is fixed by inserting a recording medium having the toner image formed on a surface into a contact portion between the first rotating body and the second rotating body. Then, the fixing belt according to the present disclosure is applied as least one of the first rotating body or the second rotating body. Further, in the fixing device according to the present disclosure, for example, it is preferable that at least one of the first rotating body or the second rotating body to which the fixing belt according to the present disclosure is applied has a heat source inside.

Hereinafter, as an exemplary embodiment of the fixing device according to the present disclosure, a fixing device including a heating belt to which the fixing belt according to the present disclosure is applied and a heating roll will be described.

The fixing device according to the present disclosure is not limited to the exemplary embodiment, and may be a fixing device including a heating belt and a pressure belt, or a fixing device including a heating roll and a pressure belt. In these fixing devices, the fixing belt according to the present disclosure may be applied to both the heating belt and the pressure belt.

Third Exemplary Embodiment of Fixing Device

Figure 2:
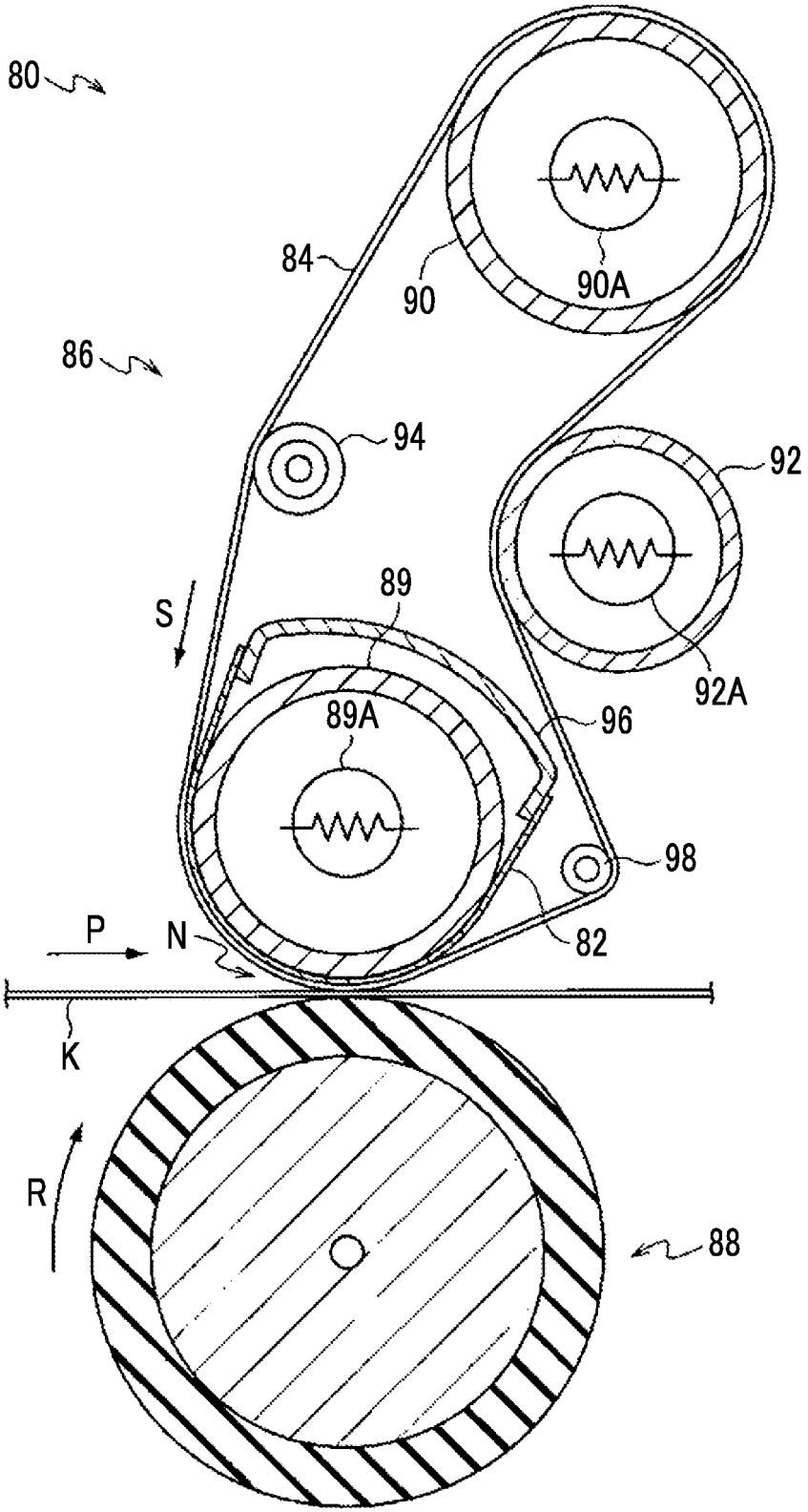
FIG. 2 is a schematic configuration diagram showing an example of an exemplary embodiment of the fixing device according to the present disclosure.

The first exemplary embodiment of the fixing device will be described with reference to FIG. 2. FIG. 2 is a schematic diagram showing an example of an exemplary embodiment of the fixing device (that is, a fixing device 80).

As shown in FIG. 2, the fixing device 80 is configured to include, for example, a fixing belt module 86 including a heating belt 84 (an example of the first rotating body) and a pressure roll 88 (an example of the second rotating body) arranged by being pressed to the heating belt 84 (the fixing belt module 86). For example, the sandwiching region N (nip portion) is formed in a contact portion between the heating belt 84 (fixing belt module 86) and the pressure roll 88. In the sandwiching region N, the paper K (an example of the recording medium) is pressed and heated, and the toner image is fixed.

The fixing belt module 86 includes, for example, an endless heating belt 84, a heating pressing roll 89 around which the heating belt 84 is wound on the pressure roll 88 side, and which is rotationally driven by the rotational force of a motor (not shown) and presses the heating belt from an inner peripheral surface thereof toward the pressure roll 88, and a support roll 90 that supports the heating belt 84 from the inside at a position different from the heating pressing roll 89.

The fixing belt module 86 is, for example, provided with a support roll 92 that is arranged outside the heating belt 84 and defines a circuit path thereof, and a posture correction roll 94 that corrects the posture of the heating belt 84 from the heating pressing roll 89 to the supporting roll 90, and a support roll 98 that applies tension to the heating belt 84 from the inner peripheral surface on the downstream side of the sandwiching region N formed by the heating belt 84 and the pressure roll 88.

The fixing belt module 86 is provided, for example, so that a sheet-shaped sliding member 82 is interposed between the heating belt 84 and the heating pressing roll 89.

The sliding member 82 is provided, for example, so that a sliding surface thereof is in contact with an inner peripheral surface of the heating belt 84, and is involved in holding and supplying an oil existing between the sliding member 82 and the heating belt 84.

Here, the sliding member 82 is provided, for example, in a state where both ends thereof are supported by the support member 96.

Inside the heating pressing roll 89, for example, a halogen heater 89A (an example of heating source) is provided.

The support roll 90 is, for example, a cylindrical roll formed of aluminum, and a halogen heater 90A (an example of heating source) is arranged inside, so that the heating belt 84 is heated from the inner peripheral surface side.

At both ends of the support roll 90, for example, spring members (not shown) that press the heating belt 84 outward are arranged.

The support roll 92 is, for example, a cylindrical roll made of aluminum, and a release layer consisting of a fluororesin having a thickness of 20 μm is formed on a surface of the support roll 92.

The release layer of the support roll 92 is formed, for example, to prevent a toner or a paper dust from the outer peripheral surface of the heating belt 84 from accumulating on the support roll 92.

For example, a halogen heater 92A (an example of the heating source) is arranged inside the support roll 92 so that the heating belt 84 is heated from the outer peripheral surface side.

That is, for example, the heating pressing roll 89, the support roll 90, and the support roll 92 are configured to heat the heating belt 84.

The posture correction roll 94 is, for example, a columnar roll formed of aluminum, and an end position measurement mechanism (not shown) for measuring the end position of the heating belt 84 is arranged in the vicinity of the posture correction roll 94.

The posture correction roll 94 is provided with, for example, an axial displacement mechanism (not shown) that displaces a contact position of the heating belt 84 in an axial direction according to the measurement result of the end position measuring mechanism, and is configured to control meandering of the heating belt 84.

On the other hand, the pressure roll 88 is provided, for example, rotatably supported, and the heating belt 84 is provided by being pressed against a portion wound around the heating pressing roll 89 by an urging unit such as a spring (not shown). As a result, as the heating belt 84 (heating pressing roll 89) of the fixing belt module 86 rotates in a direction of an arrow S, the pressure roll 88 follows the heating belt 84 (heating pressing roll 89) and moves in a direction of an arrow R.

Then, the paper K having the unfixed toner image (not shown) is transported in a direction of the arrow P and guided to the sandwiching region N of the fixing device 80. When the paper K passes through the sandwiching region N, the unfixed toner image on the paper K is fixed by the pressure and heat acting on the sandwiching region N.

In the fixing device 80, a form in which the halogen heater (halogen lamp) is adopted as an example of plural heating sources has been described, but the present disclosure is not limited thereto. A radiation lamp heating element (a heating element that generates radiation (such as infrared rays) and a resistance heating element (heating element that generates Joule heat by passing an electric current through a resistor: for example, a ceramic substrate formed with a film having resistance and fired) may be adopted.

Image Forming Apparatus

Next, the image forming apparatus according to the present disclosure will be described.

The image forming apparatus according to the present disclosure includes an image holder; a charging unit that charges a surface of the image holder; an electrostatic latent image forming unit that forms an electrostatic latent image on the charged surface of the image holder; a developing unit that develops the electrostatic latent image formed on the surface of the image holder by a developer containing a toner to form a toner image; a transfer unit that transfers the toner image to a surface of a recording medium; and a fixing unit that fixes the toner image to the recording medium.

As the fixing unit, the fixing device according to the present disclosure is adopted.

Here, in the image forming apparatus according to the present disclosure, the fixing device may be made into a cartridge so as to be attached to and detached from the image forming apparatus. That is, the image forming apparatus according to the present disclosure may include the fixing device according to the present disclosure as a configuring device of a process cartridge.

Hereinafter, the image forming apparatus according to the present disclosure will be described with reference to the drawings.

Figure 3:
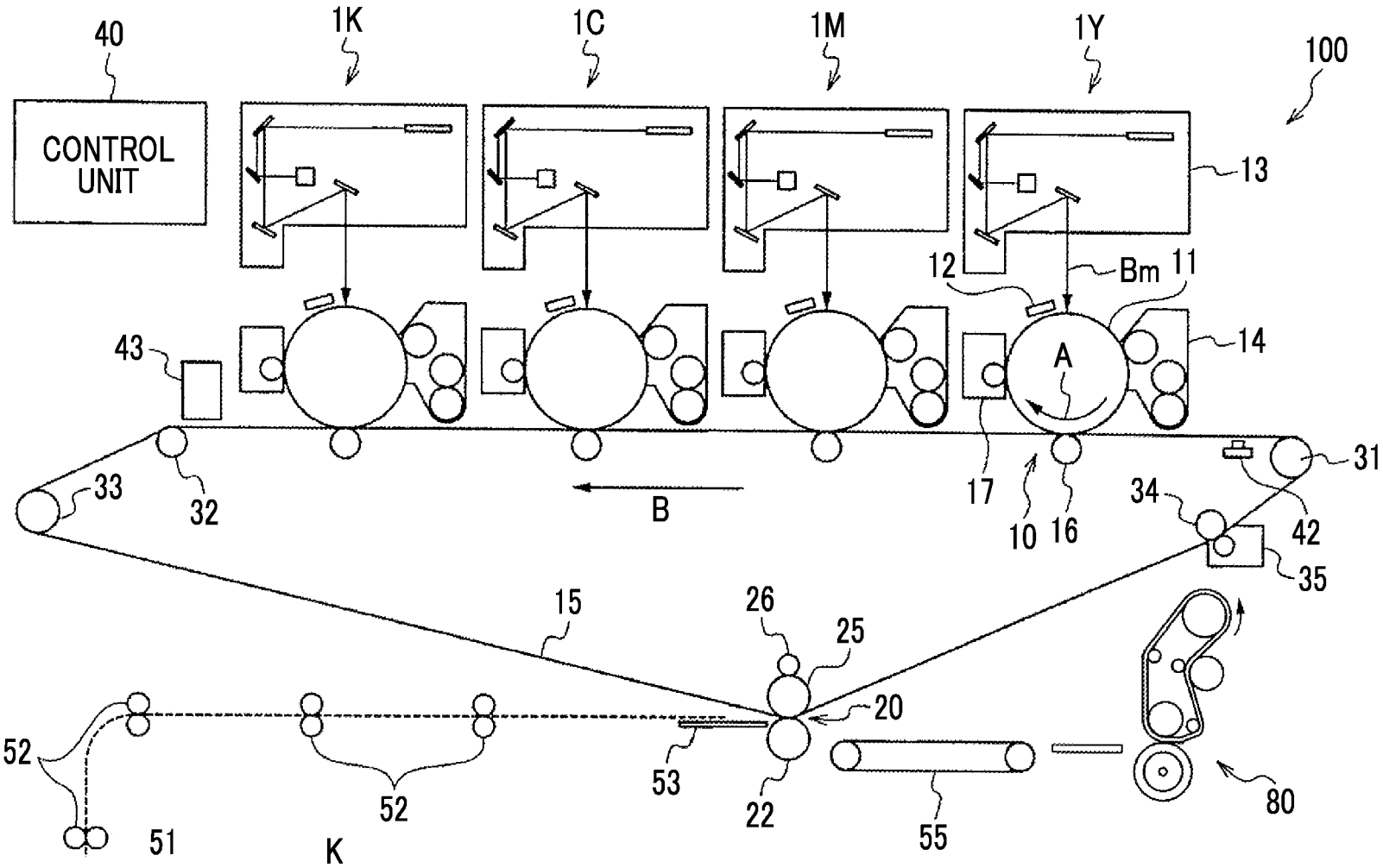
FIG. 3 is a schematic configuration diagram showing an example of an exemplary embodiment of an image forming apparatus according to the present disclosure.

FIG. 3 is a schematic configuration diagram showing an example of an exemplary embodiment of an image forming apparatus according to the present disclosure.

As shown in FIG. 3, an image forming apparatus 100 according to the present disclosure is, for example, an intermediate transfer type image forming apparatus generally called a tandem type, and includes: plural image forming units 1Y, 1M, 1C, and 1K in which each color component toner image is formed by electrophotographic method; a primary transfer unit 10 that sequentially transfers (primary transfer) each color component toner image formed by each of the image forming units 1Y, 1M, 1C, and 1K to an intermediate transfer belt 15; a secondary transfer unit 20 that collectively transfers (secondary transfer) superimposed toner image transferred on the intermediate transfer belt 15 to paper K, which is a recording medium; and a fixing device 80 that fixes a secondary transferred image on the paper K. Further, the image forming apparatus 100 has a control unit 40 that controls an operation of each device (each unit).

The fixing device 80 is the exemplary embodiment of the fixing device according to the present disclosure described above. The image forming apparatus 100 may include the fixing device according to the present disclosure, and is not limited to the fixing device 80.

Each of the image forming units 1Y, 1M, 1C, and 1K of the image forming apparatus 100 includes a photoconductor 11 that rotates in the direction of the arrow A as an example of an image holder that holds a toner image formed on the surface.

Around the photoconductor 11 as an example of a charging unit, a charger 12 that charges the photoconductor is provided and a laser exposure machine 13 (in the drawing, an exposure beam is indicated by the reference numeral Bm) that writes an electrostatic latent image on the photoconductor 11 as an example of the latent image forming unit is provided.

Further, around the photoconductor 11, a developing machine 14 in which each color component toner is accommodated and the electrostatic latent image on the photoconductor 11 is visualized by a toner is provided as an example of the developing unit, and a primary transfer roll 16 that transfers the toner image of each color component formed on the photoconductor 11 to the intermediate transfer belt 15 by the primary transfer unit 10.

Further, around the photoconductor 11, a photoconductor cleaner 17 that removes a residual toner on the photoconductor 11 is provided, and electrophotographic devices of the charger 12, the laser exposure machine 13, the developing machine 14, the primary transfer roll 16, and the photoconductor cleaner 17 are sequentially provided along the rotation direction of the photoconductor 11. These image forming units 1Y, 1M, 1C, and 1K are arranged substantially linearly in the order of yellow (Y), magenta (M), cyan (C), and black (K) from the upstream side of the intermediate transfer belt 15.

The intermediate transfer belt 15 which is an intermediate transfer body is configured of a film-shaped pressure belt in which a resin such as polyimide or polyamide is used as a base layer and an appropriate amount of an antistatic agent such as carbon black is contained. The intermediate transfer belt is formed to have a volume resistivity of $10^6$ Ωcm or more and $10^{14}$ Ωcm or less, and is configured to have a thickness of, for example, about 0.1 mm.

The intermediate transfer belt 15 is circulated (rotated) by various rolls in a B direction shown in FIG. 3 at a speed appropriate for the purpose. Examples of the various rolls include: a drive roll 31 that is driven by a motor (not shown) having excellent constant speed to rotate the intermediate transfer belt 15; a support roll 32 that supports the intermediate transfer belt 15 extending substantially linearly along the arrangement direction of each photoconductor 11; a tension applying roll 33, which applies tension to the intermediate transfer belt 15 and functions as a correction roll for preventing the intermediate transfer belt 15 from meandering; a back surface roll 25 provided on the secondary transfer unit 20; and a cleaning back surface roll 34 provided in the cleaning portion that scraps off the residual toner on the intermediate transfer belt 15.

The primary transfer unit 10 is configured of the primary transfer roll 16 arranged so as to face the photoconductor 11 with the intermediate transfer belt 15 interposed therebetween. The primary transfer roll 16 is configured of a core body and a sponge layer as an elastic layer fixed around the core body. The core body is a cylindrical rod made of a metal such as iron or SUS. The sponge layer is a sponge-like cylindrical roll which is formed of a blended rubber of NBR, SBR, and EPDM containing a conductive agent such as carbon black and has the volume resistivity of $10^{7.5}$ Ωcm or more and $10^{8.5}$ Ωcm or less.

Then, the primary transfer roll 16 is arranged to be in contact with the photoconductor 11 with the intermediate transfer belt 15 interposed therebetween, and is configured such that the primary transfer roll 16 has a charging polarity (minus polarity) of the toner and the same applies below) and the opposite polarity voltage (primary transfer bias) are applied. As a result, the toner images on the respective photoconductors 11 are sequentially electrostatically attracted to the intermediate transfer belt 15, and the superimposed toner images are formed on the intermediate transfer belt 15.

The secondary transfer unit 20 is configured to include the back surface roll 25 and the secondary transfer roll 22 arranged on the toner image holding surface side of the intermediate transfer belt 15.

In the back surface roll 25, the surface is configured of a tube of the blended rubber of EPDM and NBR rubber in which carbon is dispersed, and the inside is configured of EPDM rubber. Then, the back surface roll is formed to have the surface resistivity of $10^7$Ω/□ or more and $10^{10}$Ω/□ or less, and the hardness is set to, for example, 70° (ASKER C: manufactured by KOBUNSHI KEIKI Co., Ltd., the same applies below). The back surface roll 25 is arranged on the back surface side of the intermediate transfer belt 15 to configure a counter electrode of the secondary transfer roll 22, and a power feeding roll 26 made of metal to which the secondary transfer bias is stably applied is contact-arranged.

The secondary transfer roll 22 is configured of a core body and a sponge layer as an elastic layer fixed around the core body. The core body is a cylindrical rod configured of a metal such as iron or SUS. The sponge layer is a sponge-like cylindrical roll which is formed of a blended rubber of NBR, SBR, and EPDM containing a conductive agent such as carbon black and has the volume resistivity of $10^{7.5}$ Ωcm or more and $10^{8.5}$ Ωcm or less.

Moreover, the secondary transfer roll 22 is arranged to be in contact with the back surface roll 25 with the intermediate transfer belt 15 interposed therebetween, and the secondary transfer roll 22 is grounded to form a secondary transfer bias with the back surface roll 25. The toner image is secondarily transferred onto the paper K transported to the secondary transfer unit 20.

Further, on the downstream side of the secondary transfer unit 20 of the intermediate transfer belt 15, an intermediate transfer belt cleaner 35 that cleans the surface of the intermediate transfer belt 15 by removing residual toner or paper dust on the intermediate transfer belt 15 after the secondary transfer is provided so as to be detachable from the intermediate transfer belt 15.

The intermediate transfer belt 15, the primary transfer unit 10 (primary transfer roll 16), and the secondary transfer unit 20 (secondary transfer roll 22) correspond to an example of the transfer unit.

On the other hand, on the upstream side of the yellow image forming unit 1Y, a reference sensor (home position sensor) 42 that generates a reference signal as a reference for taking the image forming timing in each of the image forming units 1Y, 1M, 1C, and 1K is provided. The reference sensor 42 recognizes a mark provided on the back side of the intermediate transfer belt 15 and generates a reference signal. According to an instruction from the control unit 40 based on the recognition of the reference signal, each of the image forming units 1Y, 1M, 1C, and 1K is configured to start image formation.

Further, on the downstream side of the black image forming unit 1K, an image density sensor 43 that adjusts an image quality is arranged.

Further, the image forming apparatus according to the present disclosure includes, as a transporting unit that transports the paper K, a paper accommodating unit 50 that accommodates the paper K; a paper feed roll 51 that takes out and transports the paper K accumulated in the paper accommodating unit 50 at a predetermined timing; a transport roll 52 that transports the paper K fed by the paper feed roll 51; a transport guide 53 that feeds the paper K transported by the transport roll 52 to the secondary transfer unit 20; a transport belt 55 that transports the paper K transported after being secondarily transferred by the secondary transfer roll 22, to the fixing device 60; and a fixing inlet guide 56 that guides the paper K to the fixing device 60.

Next, a basic image forming process of the image forming apparatus according to the present disclosure will be described.

In the image forming apparatus according to the present disclosure, image data output from an image reading device (not shown), a personal computer (PC) (not shown), or the like is subjected to image processing by an image processing device (not shown), and then the image forming units 1Y, 1M, 1C, and 1K execute an image forming work.

The image processing device performs image processing such as various image editing such as shading correction, position shift correction, brightness/color space conversion, gamma correction, frame erasing or color editing, and movement editing on the input reflectance data. The image data subjected to the image processing is converted into color material gradation data of four colors of Y, M, C, and K, and is output to the laser exposure machine 13.

In the laser exposure machine 13, for example, the exposure beam Bm emitted from the semiconductor laser is applied to the photoconductors 11 of the image forming units 1Y, 1M, 1C, and 1K according to the input color material gradation data. In each of the photoconductors 11 of the image forming units 1Y, 1M, 1C, and 1K, after the surface is charged by the charger 12, the surface is scanned and exposed by the laser exposure machine 13, and an electrostatic latent image is formed. The formed electrostatic latent image is developed as a toner image of each color of Y, M, C, and K by the each of the image forming units 1Y, 1M, 1C, and 1K.

The toner image formed on the photoconductors 11 of the image forming units 1Y, 1M, 1C, and 1K is transferred onto the intermediate transfer belt 15 in the primary transfer unit 10 in which each photoconductor 11 and the intermediate transfer belt 15 come into contact with each other. More specifically, in the primary transfer unit 10, the primary transfer roll 16 applies a voltage (primary transfer bias) opposite to the charging polarity (minus polarity) of the toner to the base material of the intermediate transfer belt 15, and the toner image is sequentially superposed on the surface of the intermediate transfer belt 15 to perform the primary transfer.

After the toner image is sequentially primary-transferred to the surface of the intermediate transfer belt 15, the intermediate transfer belt 15 moves and the toner image is transported to the secondary transfer unit 20. In a case where the toner image is transported to the secondary transfer unit 20, in the transporting unit, the paper feed roll 51 rotates in accordance with the timing at which the toner image is transported to the secondary transfer unit 20, and the paper K having a target size is supplied from the paper accommodating unit 50. The paper K supplied by the paper feed roll 51 is transported by the transport roll and reaches the secondary transfer unit 20 via the transport guide 53. Before reaching the secondary transfer unit 20, the paper K is temporarily stopped, and the alignment roll (not shown) rotates according to the movement timing of the intermediate transfer belt 15 on which the toner image is held. Therefore, the position of the paper K and the position of the toner image are aligned.

In the secondary transfer unit 20, the secondary transfer roll 22 is pressed against the back surface roll 25 via the intermediate transfer belt 15. In this case, the paper K transported at the same timing is sandwiched between the intermediate transfer belt 15 and the secondary transfer roll 22. At that time, in a case where a voltage (secondary transfer bias) having the same polarity as the charging polarity (minus polarity) of the toner is applied from the power feeding roll 26, a transfer electric field is formed between the secondary transfer roll 22 and the back surface roll 25. The unfixed toner image held on the intermediate transfer belt 15 is electrostatically transferred onto the paper K collectively in the secondary transfer unit 20 pressed by the secondary transfer roll 22 and the back surface roll 25.

Thereafter, the paper K on which the toner image is electrostatically transferred is transported as-is in a state of being peeled off from the intermediate transfer belt 15 by the secondary transfer roll 22, and is transported to the transport belt 55 provided on the downstream side of the secondary transfer roll 22 in the paper transport direction. The transport belt 55 transports the paper K to the fixing device 60 according to the optimum transport speed in the fixing device 60. The unfixed toner image on the paper K transported to the fixing device 60 is fixed on the paper K by being subjected to a fixing process by heat and pressure by the fixing device 60. The paper K on which the fixed image is formed is transported to an ejected paper accommodating portion (not shown) provided in the ejection unit of the image forming apparatus.

On the other hand, after the transfer to the paper K is completed, the residual toner remaining on the intermediate transfer belt 15 is transported to the cleaning unit as the intermediate transfer belt 15 rotates, and is removed from the intermediate transfer belt 15 by the cleaning back surface roll 34 and the intermediate transfer belt cleaner 35.

Although the present exemplary embodiment has been described above, the present disclosure is not limited to the above exemplary embodiments, and various modifications, changes, and improvements may be made.

EXAMPLES

Hereinafter, the present disclosure will be described in more detail with reference to examples. However, the present disclosure is not limited to the following examples.

Example 1

Formation of Base Material Layer

N-Methyl-2-pyrrolidone (NMP) and carbon nanotubes (manufactured by Showa Denko KK) are mixed at a mass ratio of 95:5 to prepare a dispersion liquid (hereinafter, also referred to as "CNT 5% dispersion"). The obtained dispersion liquid is subjected to a high-pressure dispersion treatment with a high-pressure homogenizer (HC3 manufactured by Sanmaru Kikai Kogyo Co., Ltd.) (Conditions: liquid temperature 45° C., 50 MPa, the number of times of passing through (number of passes): 5 times)).

Subsequently, 528 parts by mass of a polyamic acid solution (manufactured by Unitica: TX-HMM (polyimide varnish), solid content concentration: 18% by mass, solvent: NMP) is added to 100 parts by mass of the dispersion liquid after the high-pressure dispersion treatment to prepare a precursor liquid. The obtained precursor liquid is agitated with a planetary mixer (ACM-5LVT manufactured by Aikosha Seisakusho Co., Ltd.) for 15 minutes under a condition of liquid temperature of 30° C. while performing vacuuming.

As described above, a base material layer-forming coating liquid containing 5% by mass of an aggregate (that is, a specific aggregate) in which plural carbon nanotubes are entangled with each other in the solid content is obtained.

Next, the obtained base material layer-forming coating liquid is applied onto a cylindrical mold to form a coating film, and the coating film is fired at 380° C. to form a seamless belt-shaped base material layer having a film thickness of 80 μm.

Formation of Elastic Layer

A butyl acetate and carbon nanotubes (manufactured by Showa Denko KK) are mixed at a mass ratio of 85:15 to prepare a dispersion liquid (hereinafter, also referred to as "CNT 15% dispersion"). The obtained dispersion liquid is subjected to a high-pressure dispersion treatment with a high-pressure homogenizer (HC3 manufactured by Sanmaru Kikai Kogyo Co., Ltd.) (Conditions: liquid temperature 45° C., 50 MPa, the number of times of passing through (number of passes): 3 times)).

Subsequently, 50 parts by mass of a silicone rubber stock solution (X-34-1053 manufactured by Shin-Etsu Chemical Co., Ltd., solid content concentration: 60% by mass, solvent: butyl acetate) is added to 50 parts by mass of the dispersion liquid after the high-pressure dispersion treatment to prepare a precursor liquid. The obtained precursor liquid is agitated with a planetary mixer (ACM-SLVT manufactured by Aikosha Seisakusho Co., Ltd.) for 10 minutes under a condition of liquid temperature of 30° C. while performing vacuuming.

As described above, an elastic layer-forming coating liquid containing 20% by mass of an aggregate (that is, a specific aggregate) in which plural carbon nanotubes are entangled with each other in the solid content is obtained.

Next, the obtained elastic layer-forming coating liquid is applied onto the base material layer to form a coating film, and the coating film is heated at 100° C. for 30 minutes to form an elastic layer having a film thickness of 450 μm.

Formation of Release Layer

A PFA tube (manufactured by Gunze Co., Ltd.) having a film thickness of 35 μm is placed on an elastic layer and heated at 200° C. for 120 minutes to form a release layer consisting of a fluororesin tube.

Through the above steps, a fixing belt is obtained.

Examples 2 to 5

A fixing belt is produced in the same manner as in Example 1 except that the method for forming the base material layer and the elastic layer is changed to the following method.

That is, the base material layer is formed in the same manner as in Example 1, except that in the formation of the base material layer of Example 1, the number of passes of the CNT 5% dispersion liquid through the high-pressure dispersion treatment and the agitating time of the precursor liquid by the planetary mixer are appropriately set as follows.

Example 2: the number of passes of the CNT 5% dispersion liquid through the high-pressure dispersion treatment is 3 times, and the agitating time of the precursor liquid by the planetary mixer is 40 minutes Example 3: the number of passes of the CNT 5% dispersion liquid through the high-pressure dispersion treatment is 8 times, and the agitating time of the precursor liquid by the planetary mixer is 10 minutes Example 4: the number of passes of the CNT 5% dispersion liquid through the high-pressure dispersion treatment is 5 times, and the agitating time of the precursor liquid by the planetary mixer is 15 minutes Example 5: the number of passes of the CNT 5% dispersion liquid through the high-pressure dispersion treatment is 5 times, and the agitating time of the precursor liquid by the planetary mixer is 15 minutes Also, the elastic layer is formed in the same manner as in Example 1, except that in the formation of the elastic layer of Example 1, the number of passes of the CNT 15% dispersion liquid through the high-pressure dispersion treatment and the agitating time of the precursor liquid by the planetary mixer are appropriately set as follows.

Example 2: the number of passes of the CNT 15% dispersion liquid through the high-pressure dispersion treatment is 3 times, and the agitating time of the precursor liquid by the planetary mixer is 10 minutes Example 3: the number of passes of the CNT 15% dispersion liquid through the high-pressure dispersion treatment is 3 times, and the agitating time of the precursor liquid by the planetary mixer is 10 minutes Example 4: the number of passes of the CNT 15% dispersion liquid through the high-pressure dispersion treatment is 2 times, and the agitating time of the precursor liquid by the planetary mixer is 60 minutes Example 5: the number of passes of the CNT 15% dispersion liquid through the high-pressure dispersion treatment is 3 times, and the agitating time of the precursor liquid by the planetary mixer is 8 minutes Examples 6 to 10

A fixing belt is produced in the same manner as in Example 1 except that the method for forming the base material layer and the elastic layer is changed to the following method.

That is, the base material layer is formed in the same manner as in Example 1 except that, in the formation of the base material layer of Example 1, the amount of the CNT 5% dispersion liquid after the high-pressure dispersion treatment and the amount of the polyamic acid solution are set as follows as appropriate.

Example 6: 1 part by mass of CNT 5% dispersion liquid after the high-pressure dispersion treatment and 280 parts by mass of polyamic acid solution Example 7: 100 parts by mass of CNT 5% dispersion liquid after the high-pressure dispersion treatment and 250 parts by mass of polyamic acid solution Example 8: 1 part by mass of CNT 5% dispersion liquid after the high-pressure dispersion treatment and 280 parts by mass of polyamic acid solution Example 9: 100 parts by mass of CNT 5% dispersion liquid after the high-pressure dispersion treatment and 111.1 parts by mass of polyamic acid solution Example 10: 100 parts by mass of CNT 5% dispersion liquid after the high-pressure dispersion treatment and 98.5 parts by mass of polyamic acid solution In addition, the elastic layer is formed in the same manner as in Example 1 except that, in the formation of the elastic layer of Example 1, the amount of the CNT 15% dispersion liquid after the high-pressure dispersion treatment and the amount of the silicone rubber stock solution are set as follows as appropriate.

Example 6: 0.4 parts by mass of the CNT 15% dispersion liquid after the high-pressure dispersion treatment and 99.6 parts by mass of the silicone rubber stock solution Example 7: 0.4 parts by mass of the CNT 15% dispersion liquid after the high-pressure dispersion treatment and 99.6 parts by mass of the silicone rubber stock solution Example 8: 50 parts by mass of the CNT 15% dispersion liquid after the high-pressure dispersion treatment and 50 parts by mass of the silicone rubber stock solution Example 9: 72.8 parts by mass of the CNT 15% dispersion liquid after the high-pressure dispersion treatment and 27.3 parts by mass of the silicone rubber stock solution Example 10: 76.58 parts by mass of the CNT 15% dispersion liquid after the high-pressure dispersion treatment and 23.4 parts by mass of the silicone rubber stock solution Examples 11 to 17

A fixing belt is produced in the same manner as in Example 1 except that the method for forming the base material layer and the elastic layer is changed to the following method.

That is, the base material layer is formed in the same manner as in Example 1 except that, in the formation of the base material layer of Example 1, a coating liquid obtained by preparing a precursor liquid in which the amount of the CNT 5% dispersion liquid after the high-pressure dispersion treatment and the amount of the polyamic acid solution are set as follows as appropriate, agitating the precursor liquid with a planetary mixer, thereafter, adding a CNT 5% dispersion liquid used in Example 1 in the amount as follows, and further agitating the mixture with the planetary mixer under the conditions of temperature 30° C., at a normal pressure, for 1 minute is used.

Example 11: 100 parts by mass of CNT 5% dispersion liquid after the high-pressure dispersion treatment, 704 parts by mass of the polyamic acid solution, and 33.3 parts by mass of the CNT 5% dispersion liquid Example 12: 33.3 parts by mass of CNT 5% dispersion liquid after the high-pressure dispersion treatment, 704 parts by mass of the polyamic acid solution, and 100 parts by mass of the CNT 5% dispersion liquid Example 13: 66.6 parts by mass of CNT 5% dispersion liquid after the high-pressure dispersion treatment, 704 parts by mass of the polyamic acid solution, and 66.6 parts by mass of the CNT 5% dispersion liquid Example 14: 126.6 parts by mass of CNT 5% dispersion liquid after the high-pressure dispersion treatment, 704 parts by mass of the polyamic acid solution, and 6.6 parts by mass of the CNT 5% dispersion liquid Example 15: 100 parts by mass of CNT 5% dispersion liquid after the high-pressure dispersion treatment, 704 parts by mass of the polyamic acid solution, and 33.3 parts by mass of the CNT 5% dispersion liquid Example 16: 100 parts by mass of CNT 5% dispersion liquid after the high-pressure dispersion treatment, 704 parts by mass of the polyamic acid solution, and 33.3 parts by mass of the CNT 5% dispersion liquid Example 17: 100 parts by mass of CNT 5% dispersion liquid after the high-pressure dispersion treatment, 704 parts by mass of the polyamic acid solution, and 33.3 parts by mass of the CNT 5% dispersion liquid Also, the elastic layer is formed in the same manner as in Example 1 except that, in the formation of the elastic layer of Example 1, a coating liquid obtained by preparing a precursor liquid in which the amount of the CNT 15% dispersion liquid after the high-pressure dispersion treatment and the amount of the silicone rubber stock solution are set as follows, agitating the precursor liquid with a planetary mixer, thereafter, adding a CNT 15% dispersion liquid used in Example 1 in the amount as follows, and further agitating the mixture with the planetary mixer under the conditions of temperature 30° C., at a normal pressure, for 1 minute is used.

Example 11: 33.15 parts by mass of the CNT 15% dispersion liquid after the high-pressure dispersion treatment, 65 parts by mass of the silicone rubber stock solution, and 1.48 parts by mass of CNT 15% dispersion liquid Example 12: 33.15 parts by mass of the CNT 15% dispersion liquid after the high-pressure dispersion treatment, 65 parts by mass of the silicone rubber stock solution, and 1.48 parts by mass of CNT 15% dispersion liquid Example 13: 33.15 parts by mass of the CNT 15% dispersion liquid after the high-pressure dispersion treatment, 65 parts by mass of the silicone rubber stock solution, and 1.48 parts by mass of CNT 15% dispersion liquid Example 14: 33.15 parts by mass of the CNT 15% dispersion liquid after the high-pressure dispersion treatment, 65 parts by mass of the silicone rubber stock solution, and 1.48 parts by mass of CNT 15% dispersion liquid Example 15: 1.48 parts by mass of the CNT 15% dispersion liquid after the high-pressure dispersion treatment, 65 parts by mass of the silicone rubber stock solution, and 33.15 parts by mass of CNT 15% dispersion liquid Example 16: 21.2 parts by mass of the CNT 15% dispersion liquid after the high-pressure dispersion treatment, 65 parts by mass of the silicone rubber stock solution, and 1.42 parts by mass of CNT 15% dispersion liquid Example 17: 43.45 parts by mass of the CNT 15% dispersion liquid after the high-pressure dispersion treatment, 65 parts by mass of the silicone rubber stock solution, and 1.51 parts by mass of CNT 15% dispersion liquid Comparative Example 1

A fixing belt is produced in the same manner as in Example 1 except that each method for forming the base material layer or the elastic layer is changed to the following method.

Formation of Base Material Layer

That is, using the dispersion liquid (CNT 5% dispersion liquid) that is used in the formation of the base material layer of Example 1 and not subjected to the high-pressure dispersion treatment, 250 parts by mass of a polyamic acid solution (TX-HMM (polyimide varnish), manufactured by Unitica Co., Ltd., solid content concentration: 18% by mass, and solvent: NMP) is added to 100 parts by mass of the dispersion liquid, and mixed with a planetary mixer (condition: liquid temperature 30° C. for 1 minute) to form a base material layer-forming coating liquid. A base material layer is formed in the same manner as in Example 1 except that the base material layer-forming coating liquid is used.

Formation of Elastic Layer

That is, using the dispersion liquid (CNT 15% dispersion liquid) which is used in the formation of the elastic layer of Example 1 and is not subjected to the high-pressure dispersion treatment, 50 parts by mass of a silicone rubber stock solution (X-34-1053 manufactured by Shin-Etsu Chemical Co., Ltd., solid content concentration: 60% by mass, solvent: butyl acetate) is added to 50 parts by mass of dispersion liquid to be mixed by a planetary mixer (condition: liquid temperature 30° C. for 1 minute) to obtain the elastic layer-forming coating liquid. An elastic layer is formed on the base material layer in the same manner as in Example 1 except that the elastic layer-forming coating liquid is used.

Comparative Example 2

A fixing belt is produced in the same manner as in Example 1 except that each method for forming the base material layer or the elastic layer is changed to the following method.

Formation of Base Material Layer

A base material layer is formed in the same manner as in Example 1 except that the polyamic acid solution (manufactured by Unitika Ltd.: TX-HMM (polyimide varnish)) is used as-is, as the base material layer-forming coating liquid.

Formation of Elastic Layer

An elastic layer is formed on the base material layer in the same manner as in Example 1 except that the silicone rubber stock solution (X-34-1053 manufactured by Shin-Etsu Chemical Co., Ltd.) is used as-is as the elastic layer-forming coating liquid.

Comparative Example 3

A fixing belt is produced in the same manner as in Example 1 except that each method for forming the base material layer or the elastic layer is changed to the following method.

Formation of Base Material Layer

Using a dispersion liquid after the high-pressure dispersion treatment, which is obtained in formation of the base material layer of Example 1, 250 parts by mass of a polyamic acid solution (manufactured by Unitica: TX-HMM (polyimide varnish), solid content concentration: 18% by mass, solvent: NMP) is added to 100 parts by mass of the dispersion liquid after the high-pressure dispersion treatment to prepare a precursor liquid. The obtained precursor liquid is agitated with a planetary mixer (ACM-SLVT manufactured by Aikosha Seisakusho Co., Ltd.) for 70 minutes under a condition of liquid temperature of 30° C. while performing vacuuming.

As described above, a base material layer-forming coating liquid containing 10% by mass of an aggregate (that is, a specific aggregate) in which plural carbon nanotubes are entangled with each other in the solid content is obtained.

Next, the obtained base material layer-forming coating liquid is applied onto a cylindrical mold to form a coating film, and the coating film is fired at 380° C. to form a seamless belt-shaped base material layer having a film thickness of 80 μm.

Formation of Elastic Layer

That is, using a dispersion liquid after the high-pressure dispersion treatment, which is obtained in formation of the elastic layer of Example 1, 60 parts by mass of a silicone rubber stock solution (X-34-1053 manufactured by Shin-Etsu Chemical Co., Ltd., solid content concentration: 60% by mass, solvent: butyl acetate) is added to 50 parts by mass of the dispersion liquid after the high-pressure dispersion treatment to prepare a precursor liquid. The obtained precursor liquid is agitated with a planetary mixer (ACM-5LVT manufactured by Aikosha Seisakusho Co., Ltd.) for 80 minutes under a condition of liquid temperature of 30° C. with vacuuming.

As described above, an elastic layer-forming coating liquid containing 20% by mass of an aggregate (that is, a specific aggregate) in which plural carbon nanotubes are entangled with each other in the solid content is obtained.

Next, the obtained elastic layer-forming coating liquid is applied onto the base material layer to form a coating film, and the coating film is heated at 100° C. for 30 minutes to form an elastic layer having a film thickness of 450 μm.

Evaluation of Durability of Fixing Belt

The fixing belt obtained in each example is mounted on a fixing device of an image forming apparatus (manufactured by Fuji Xerox Co., Ltd.: Versant 3100i Press) that employs a fixing method in which the heat source is present inside the fixing belt and heat from the heat source is transferred to the toner image via the fixing belt.

Using the image forming apparatus, halftone images of Cin 50% are continuously printed at a print speed (printing speed) of 100 ppm (100 sheets per minute) on A4 paper (P paper manufactured by Fuji Xerox Business Innovation Co., Ltd.).

For every 100,000 sheets of printing, an image defect caused by wrinkles in the release layer is checked, and the number of output sheets until the fixing belt breaks and the running stops (device stops), and the durability (that is, the life) of the fixing belt is evaluated.

Here, the wrinkles of the release layer are caused by a gradual increase in the sliding resistance between the belt and the drive member (that is, the increase in torque), and are one of factors that cause the belt to break. Therefore, even in a case where the printing is continued, it can be said that as the occurrence of image defects due to the wrinkles of the release layer is slower, the fixing belt has more excellent durability.

The durability of the fixing belt is evaluated according to the following criteria.

Image Defect

A: No image defect occurs at the time of 300,000 images.

B: No image defect occurs at the time of 200,000 images, and an image defect is confirmed at the time of 200,000 images.

C: No image defect occurs at the time of 100,000 images, and an image defect is confirmed at the time of 200,000 images.

D: Image defect is confirmed at the time of 100,000 images.

Belt Break

A: Up to 300,000 sheets, no breakage in the fixing belt is seen (running did not stop).

B: In 200,000 or more sheets and less than 300,000 sheets, a breakage in the fixing belt is seen.

C: In 100,000 or more sheets and less than 200,000 sheets, a breakage in the fixing belt is seen.

D: In less than 100,000 sheets, a breakage in the fixing belt is seen.

TABLE 1

| | Base material layer | | | | | | Elastic layer | | | | | | | |
|---|---|---|---|---|---|---|---|---|---|---|---|---|---|---|
| | Film thickness [μm] | Maximum diameter [μm] | Content A1 [% by mass ] | Minor axis/Y Major axis X | Content B of fibrous carbons which are not entangled with each other | A/(A + B) | Film thickness [μm] | Maximum diameter [μm] | Content A2 [% by mass ] | Minor axis/Y Major axis X | Content B of fibrous carbons which are not entagled with each other | A/(A + B) | Image defect | Fixing belt breakage |
| Example 1 | 80 | 10 | 5 | 0.3 | 0 | — | 450 | 10 | 20 | 0.5 | 0 | — | A | A |
| Example 2 | 80 | 30 | 5 | 0.1 | 0 | — | 450 | 10 | 20 | 0.5 | 0 | — | B | B |
| Example 3 | 80 | 7 | 5 | 0.6 | 0 | — | 450 | 10 | 20 | 0.5 | 0 | — | A | A |
| Example 4 | 80 | 10 | 5 | 0.3 | 0 | — | 450 | 60 | 20 | 0.1 | 0 | — | B | A |
| Example 5 | 80 | 10 | 5 | 0.3 | 0 | — | 450 | 7 | 20 | 0.7 | 0 | — | B | A |
| Example 6 | 80 | 10 | 0.1 | 0.3 | 0 | — | 450 | 10 | 0.1 | 0.5 | 0 | — | A | A |
| Example 7 | 80 | 10 | 10 | 0.3 | 0 | — | 450 | 10 | 0.1 | 0.5 | 0 | — | A | A |
| Example 8 | 80 | 10 | 0.1 | 0.3 | 0 | — | 450 | 10 | 20 | 0.5 | 0 | — | A | A |
| Example 9 | 80 | 10 | 20 | 0.3 | 0 | — | 450 | 10 | 40 | 0.5 | 0 | — | A | A |
| Example 10 | 80 | 10 | 22 | 0.3 | 0 | — | 450 | 10 | 45 | 0.5 | 0 | — | C | B |
| Example 11 | 80 | 10 | 3.75 | 0.3 | 1.25 | 0.75 | 450 | 10 | 11.25 | 0.5 | 3.75 | 0.75 | A | A |
| Example 12 | 80 | 10 | 1.25 | 0.3 | 3.75 | 0.25 | 450 | 10 | 11.25 | 0.5 | 3.75 | 0.75 | B | A |
| Example 13 | 80 | 10 | 2.5 | 0.3 | 2.5 | 0.50 | 450 | 10 | 11.25 | 0.5 | 3.75 | 0.75 | A | A |
| Example 14 | 80 | 10 | 4.75 | 0.3 | 0.25 | 0.95 | 450 | 10 | 11.25 | 0.5 | 3.75 | 0.75 | A | A |
| Example 15 | 80 | 10 | 3.75 | 0.3 | 1.25 | 0.75 | 450 | 10 | 3.75 | 0.5 | 11.25 | 0.25 | B | A |
| Example 16 | 80 | 10 | 3.75 | 0.3 | 1.25 | 0.75 | 450 | 10 | 7.5 | 0.5 | 7.5 | 0.50 | A | A |
| Example 17 | 80 | 10 | 3.75 | 0.3 | 1.25 | 0.75 | 450 | 10 | 14.25 | 0.5 | 0.75 | 0.95 | A | A |
| Comparative Example 1 | 80 | — | 0 | — | 10 | — | 450 | 0 | 0 | — | 20 | — | D | C |
| Comparative Example 2 | 80 | — | 0 | — | 0 | — | 450 | — | 0 | — | 0 | — | D | D |
| Comparative Example 3 | 80 | 42 | 10 | 0.05 | 0 | — | 450 | 68 | 20 | 0.08 | 0 | — | C | C |

From the above results, it can be seen that the fixing belt of present examples has high durability of the fixing belt and long life as compared with the fixing belt of the comparative example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing belt comprising, in the following order:

a base material layer containing a resin;

an elastic layer containing an elastic material; and a release layer, wherein each of the base material layer and the elastic layer further contains an aggregate in which a plurality of fibrous carbons are entangled with each other, a maximum diameter of the aggregate in the base material layer is 50% or less of a film thickness of the base material layer, and a maximum diameter of the aggregate in the elastic layer is 15% or less of a film thickness of the elastic layer.

2. The fixing belt according to claim 1, wherein each of the base material layer and the elastic layer further contains fibrous carbons that are not entangled with each other.

3. The fixing belt according to claim 2, wherein in each of the base material layer and the elastic layer, a content A of the aggregate and a content B of the fibrous carbons that are not entangled with each other satisfy a relationship of A≥B on a mass basis.

4. A fixing belt according to claim 3, wherein in each of the base material layer and the elastic layer, a ratio (A/(A+B)) of a content A of the aggregate to a total amount of the content A of the aggregate and a content B of the fibrous carbons that are not entangled with each other is 0.50 or more and 0.95 or less on a mass basis.

5. The fixing belt according to claim 4, wherein a content A1 of the aggregate contained in the base material layer is 0.1% by mass or more and 20% by mass or less with respect to a total mass of the base material layer.

6. The fixing belt according to claim 5, wherein a content A2 of the aggregate contained in the elastic layer is 0.1% by mass or more and 40% by mass or less with respect to a total mass of the elastic layer.

7. The fixing belt according to claim 3, wherein a content A1 of the aggregate contained in the base material layer is 0.1% by mass or more and 20% by mass or less with respect to a total mass of the base material layer.

8. The fixing belt according to claim 3, wherein a content A2 of the aggregate contained in the elastic layer is 0.1% by mass or more and 40% by mass or less with respect to a total mass of the elastic layer.

9. A fixing belt according to claim 2, wherein in each of the base material layer and the elastic layer, a ratio (A/(A+B)) of a content A of the aggregate to a total amount of the content A of the aggregate and a content B of the fibrous carbons that are not entangled with each other is 0.50 or more and 0.95 or less on a mass basis.

10. The fixing belt according to claim 9, wherein a content A1 of the aggregate contained in the base material layer is 0.1% by mass or more and 20% by mass or less with respect to a total mass of the base material layer.

11. The fixing belt according to claim 9, wherein a content A2 of the aggregate contained in the elastic layer is 0.1% by mass or more and 40% by mass or less with respect to a total mass of the elastic layer.

12. The fixing belt according to claim 2, wherein a content A1 of the aggregate contained in the base material layer is 0.1% by mass or more and 20% by mass or less with respect to a total mass of the base material layer.

13. The fixing belt according to claim 2, wherein a content A2 of the aggregate contained in the elastic layer is 0.1% by mass or more and 40% by mass or less with respect to a total mass of the elastic layer.

14. The fixing belt according to claim 1, wherein a content A1 of the aggregate contained in the base material layer is 0.1% by mass or more and 20% by mass or less with respect to a total mass of the base material layer.

15. The fixing belt according to claim 1, wherein a content A2 of the aggregate contained in the elastic layer is 0.1% by mass or more and 40% by mass or less with respect to a total mass of the elastic layer.

16. The fixing belt according to claim 1, wherein a content A1 of the aggregate contained in the base material layer and a content A2 of the aggregate contained in the elastic layer satisfy a relationship of $A1 \leq A2$ on a mass basis.

17. The fixing belt according to claim 16, wherein the content A1 of the aggregate is 0.1% by mass or more and 20% by mass or less with respect to a total mass of the base material layer, and the content A2 of the aggregate is 0.1% by mass or more and 40% or less with respect to a total mass of the elastic layer.

18. The fixing belt according to claim 1, wherein the fibrous carbons are carbon nanotubes.

19. A fixing device comprising:

a first rotating body; and a second rotating body arranged in contact with an outer surface of the first rotating body, wherein at least one of the first rotating body or the second rotating body is the fixing belt according to claim 1, and a toner image is fixed by inserting a recording medium having the toner image formed on a surface into a contact portion between the first rotating body and the second rotating body.

20. An image forming apparatus comprising:

an image holder;

a charging unit that charges a surface of the image holder;

an electrostatic latent image forming unit that forms an electrostatic latent image on the charged surface of the image holder;

a developing unit that develops the electrostatic latent image formed on the surface of the image holder by a developer containing a toner to form a toner image;

a transfer unit that transfers the toner image to a surface of a recording medium; and a fixing unit that fixes the toner image to the recording medium and is configured of the fixing device according to claim 19.

* * * * *